US005305540A

United States Patent [19]

Blenk

[11] Patent Number: 5,305,540

[45] Date of Patent: Apr. 26, 1994

[54] ATTACHMENT DEVICE FOR RIFLE SLINGS

[75] Inventor: Gerhard Blenk, Wertach, Fed. Rep. of Germany

[73] Assignee: Horst Blaser Jagdwaffenfabrik, Isny, Fed. Rep. of Germany

[21] Appl. No.: 993,352

[22] Filed: Dec. 18, 1992

[30] Foreign Application Priority Data

Jan. 21, 1992 [DE] Fed. Rep. of Germany ..... 4201398

[51] Int. Cl.[5] ..... F41C 23/02; F41C 33/00

[52] U.S. Cl. ..... 42/85; 24/2.5; 24/265 R; 224/150; 224/913

[58] Field of Search ..... 42/85; 24/2.5, 265 R, 24/265 AL; 224/150, 913

[56] References Cited

U.S. PATENT DOCUMENTS 4,505,012 3/1985 Johnson ..... 24/2.5
4,511,070 4/1985 Hightower ..... 224/150
4,807,332 2/1989 Airaghi ..... 24/265 R
5,074,069 12/1991 Shire ..... 42/85

FOREIGN PATENT DOCUMENTS 1903000 8/1970 Fed. Rep. of Germany .

*Primary Examiner*—David H. Brown
*Attorney, Agent, or Firm*—Flynn, Thiel, Boutell & Tanis

[57] ABSTRACT

The attachment device for rifle slings comprises two eye parts (2) arranged on the stock or barrel (1) of the rifle, each with a transverse hole (3), through which a retaining pin (8) can be stuck. At each end of the rifle sling (4) there is provided a sling sleeve (5). In the middle of each sling sleeve (5) there is provided a recess (7) extending in the longitudinal direction of the sling and into which can the eye part (2) can be inserted. Each retaining pin (8) can be stuck directly through the sling sleeve (5) and has a transverse opening (9) in the vicinity of each of its two ends, through can be pulled a retaining thong (10) attached to the rifle sling (4).

20 Claims, 5 Drawing Sheets

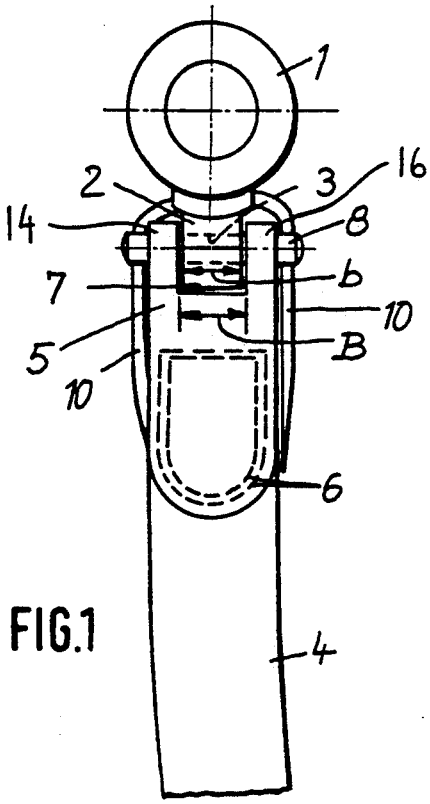
FIG.1
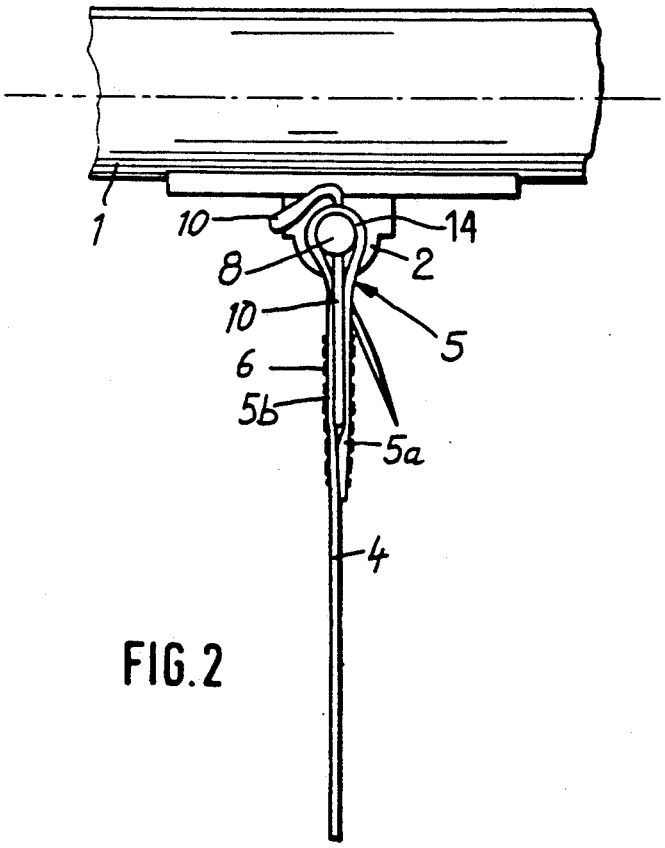
FIG.2
FIG.3
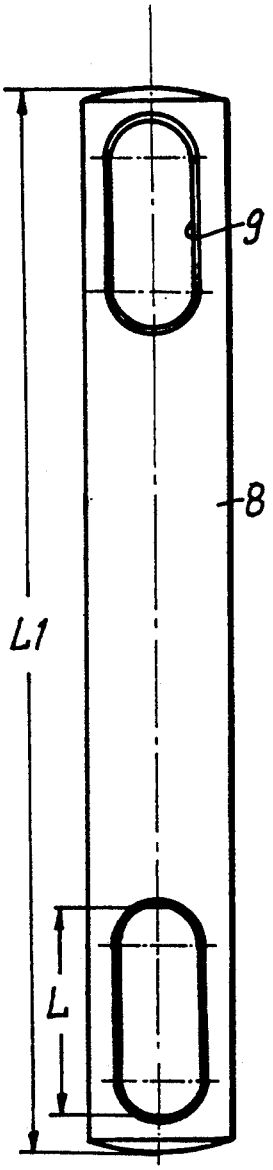

ATTACHMENT DEVICE FOR RIFLE SLINGS

FIELD OF THE INVENTION

This invention relates to an attachment device for rifle slings, with a sling sleeve provided at each end of the rifle sling and two eye parts arranged on the stock or barrel of the rifle, each with a transverse hole, through which a retaining pin can be stuck.

BACKGROUND OF THE INVENTION

In known attachment devices for rifle slings, a metal fitting is usually arranged at each sling sleeve and is for its part connectable to the respective eye part of the rifle. The fitting itself consists of an elongated metal ring, through which the rifle sling is passed to form a sling sleeve. The metal is in turn attached fixedly or with articulation to an essentially U-shaped tongue. The retaining pin is arranged slidably in transverse bores in the two arms of the tongue and has a head at one end. In the vicinity of this head and in the vicinity of its opposite end the retaining pin has indentations. A spring-loaded detent element is provided in one arm of the tongue. This metal fitting is relatively heavy and expensive to make, in addition to which it has to be matched accurately to the eye part. To fix the rifle sling to the rifle the eye part is fitted between the two U-arms of the tongue and the retaining pin is then pushed through the transverse bore of the eye part. When the retaining pin is pushed fully home, the detent element clicks into the indentation provided in the vicinity of the head. A disadvantage of this known attachment device is also that a clattering noise can occur when the tongue knocks against the barrel or there is too much play between the eye part and the tongue.

In another, similar known attachment device, the retaining pin is formed as a screw, which can be screwed in at one end into a thread in the one U-arm of the tongue. To remove the rifle sling from the rifle, the screw must be fully undone, so that a screwdriver is needed. The relatively small screws can easily be lost.

The invention is based on the object of providing an attachment device for a rifle sling of the kind initially referred to which is above all cheap to manufacture, does not create any clattering noise but nevertheless facilitates simple fitting and removal of the rifle sling.

SUMMARY OF THE INVENTION

This is achieved according to the invention in that a recess is provided in the center of each sling sleeve, extending in the direction of the length of the sling and into which the eye part can be inserted, and in that each retaining pin can be stuck directly through the sling sleeve and has a transverse opening in the region of both its ends, through which can be pulled a retaining thong attached to the rifle sling.

The novel attachment device is extremely simple to manufacture, since it consists essentially of only the retaining pin, which has a transverse hole in the vicinity of its two ends, and of one or, if desired, two retaining thongs. The usual metal fitting which has to be made accurately is obviated. The retaining pin is permanently attached to the rifle sling by the retaining thong, which is drawn through a transverse hole in the retaining pin, and cannot be lost on this account.

To attach the rifle sling to the rifle, the eye part is stuck through the recess in the sleeve. Then the retaining pin is pushed first through one sleeve half, then through the transverse hole of the eye part and then through the other sleeve half. After this has been done, the retaining thong is drawn through the second transverse hole and the retaining pin is secured in this manner in both directions. Clattering noises are completely eliminated.

Advantageous developments of the invention are characterized in the dependent claims.

BRIEF DESCRIPTION OF THE DRAWINGS

The invention is explained in more detail below, with reference to the embodiments shown in the drawings. These show:

FIG. 1 is a front view of a first embodiment,

FIG. 2 is a corresponding side view,

FIG. 3 is a view of the retaining pin enlarged about 5 times,

DETAILED DESCRIPTION

Figure 4:
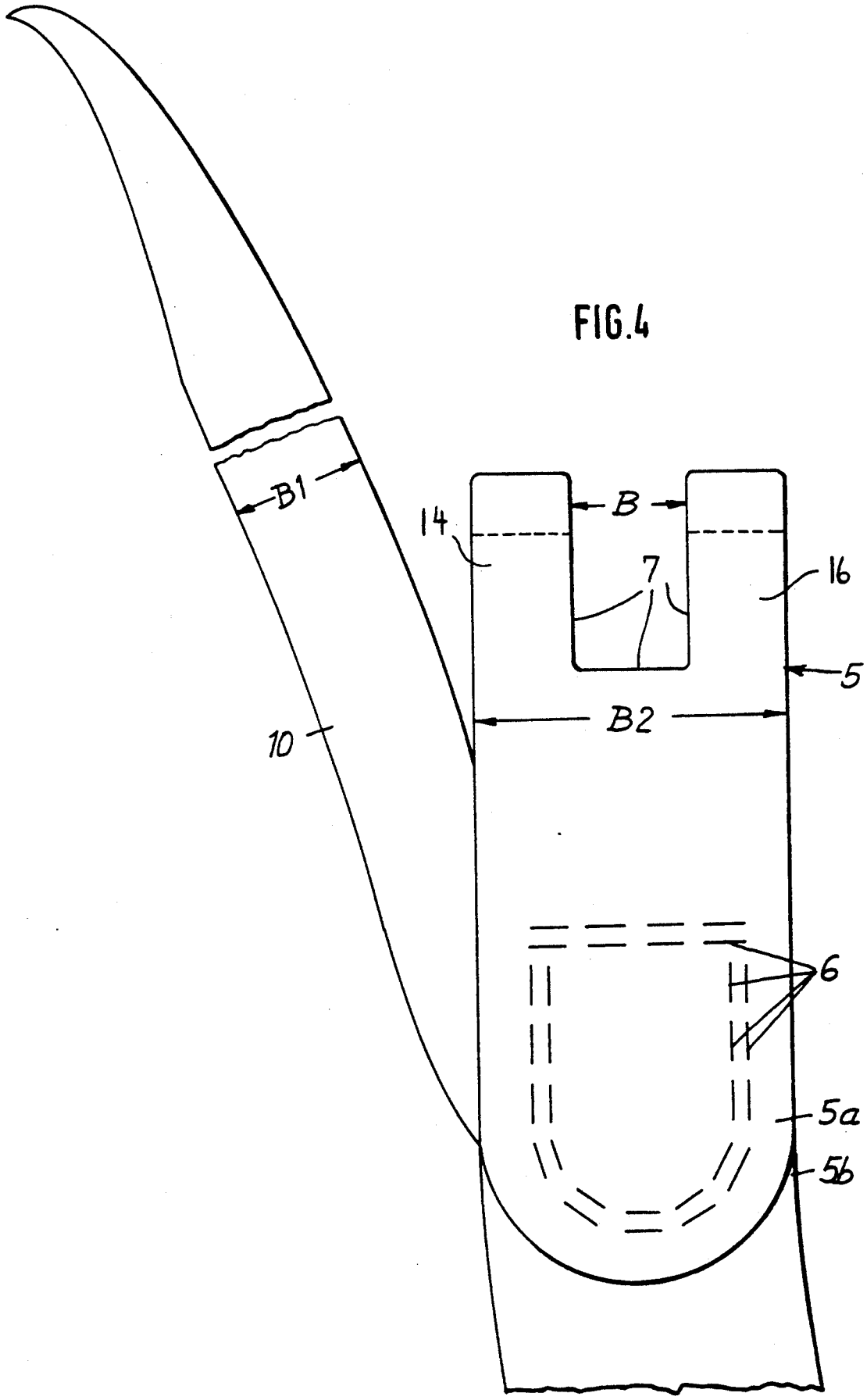
FIG. 4 is a view of the sling sleeve with a retaining thong.

A sling mount or eye part 2 is fixed to the barrel 1 and has a transverse bore 3. A similar eye part is attached to the stock 12, on the rifle. If desired the first eye part can be provided on the fore-stock instead of on the barrel. The elongate rifle sling 4 has a sling sleeve or loop 5 at each of its two ends. Each sling sleeve 5 can be formed by folding a sling section or free end portion of the sling 5*a* back through 180° relative to the other sling section or intermediate portion of the sling 5*b* and attaching it to the sling section 5*b* by seams 6.

Each sling sleeve 5 has a recess or notch 7 in its middle extending in the direction of the length of the sling, with a width B equal to or somewhat larger than the width b of the eye part 2. The recess 7 is defined by spaced-apart, circumferentially continuous loops 14 and 16. The eye part 2 can be inserted in the recess 7. A retaining pin 8 is provided for each sling sleeve 5. This cylindrical retaining pin 8 corresponds in its diameter to the diameter of the transverse bore 3 of the eye part 2. The retaining pin 8 has in the vicinity of each of its two ends a transverse opening 9, advantageously in the form of a slot. In the region of each sling sleeve 5 at least one retaining strip or thong 10 is attached to the rifle sling 4. In the embodiment shown in FIGS. 1 to 4 there is one such retaining thong 10 in the region of each sling sleeve 5, while in the embodiment shown in FIGS. 5 to 7, two retaining thongs 10, 10' are provided.

The length L of each transverse opening or slot 9 is smaller than the width B1 of the retaining thong 10 or 10'. If the length L of the slot amounts to 6 mm for example, the width B1 of the retaining thong 10, 10' should be about 8 mm.

Figure 7:
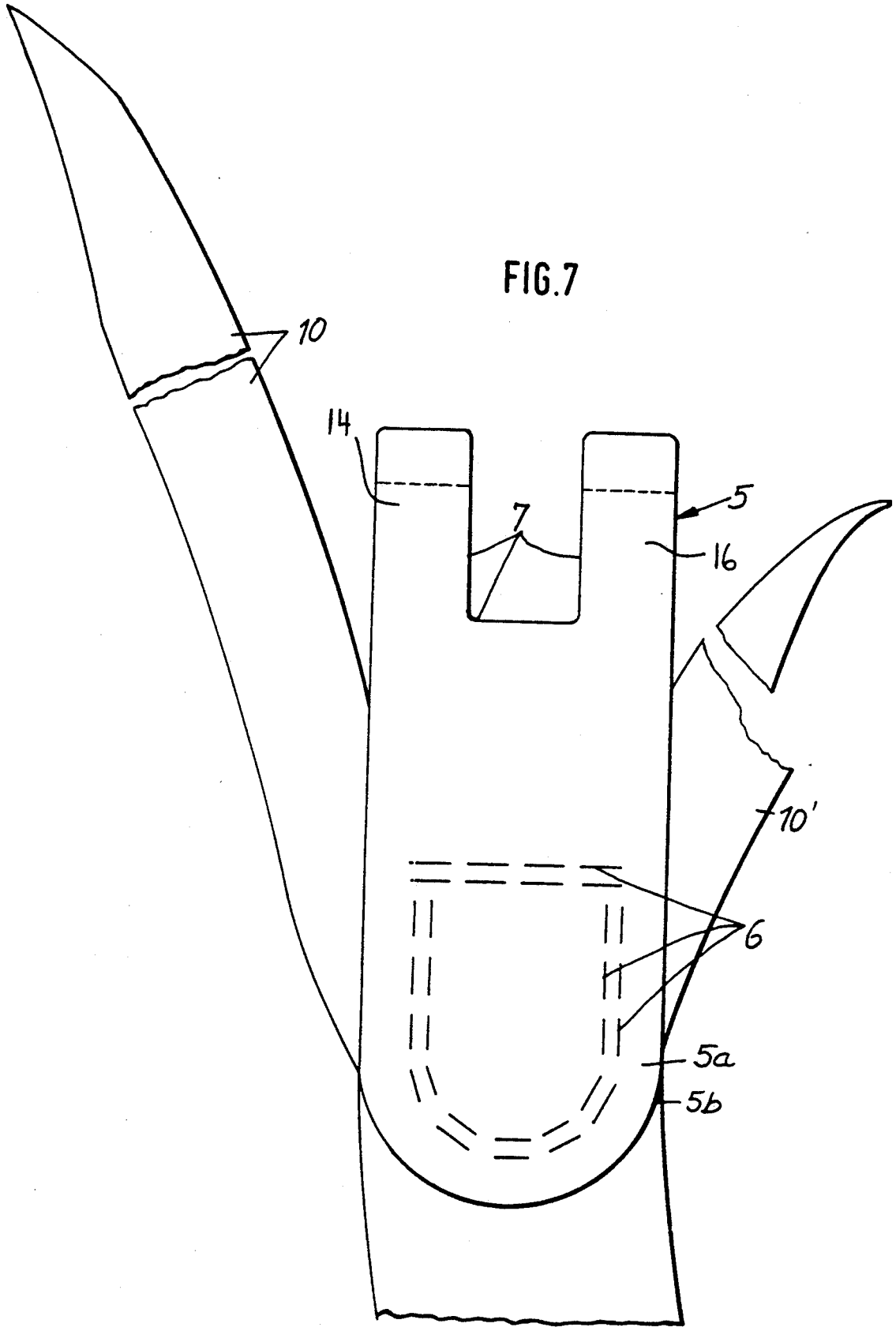
FIG. 7 is a view of the sling sleeve with two retaining thongs.
Figure 8:
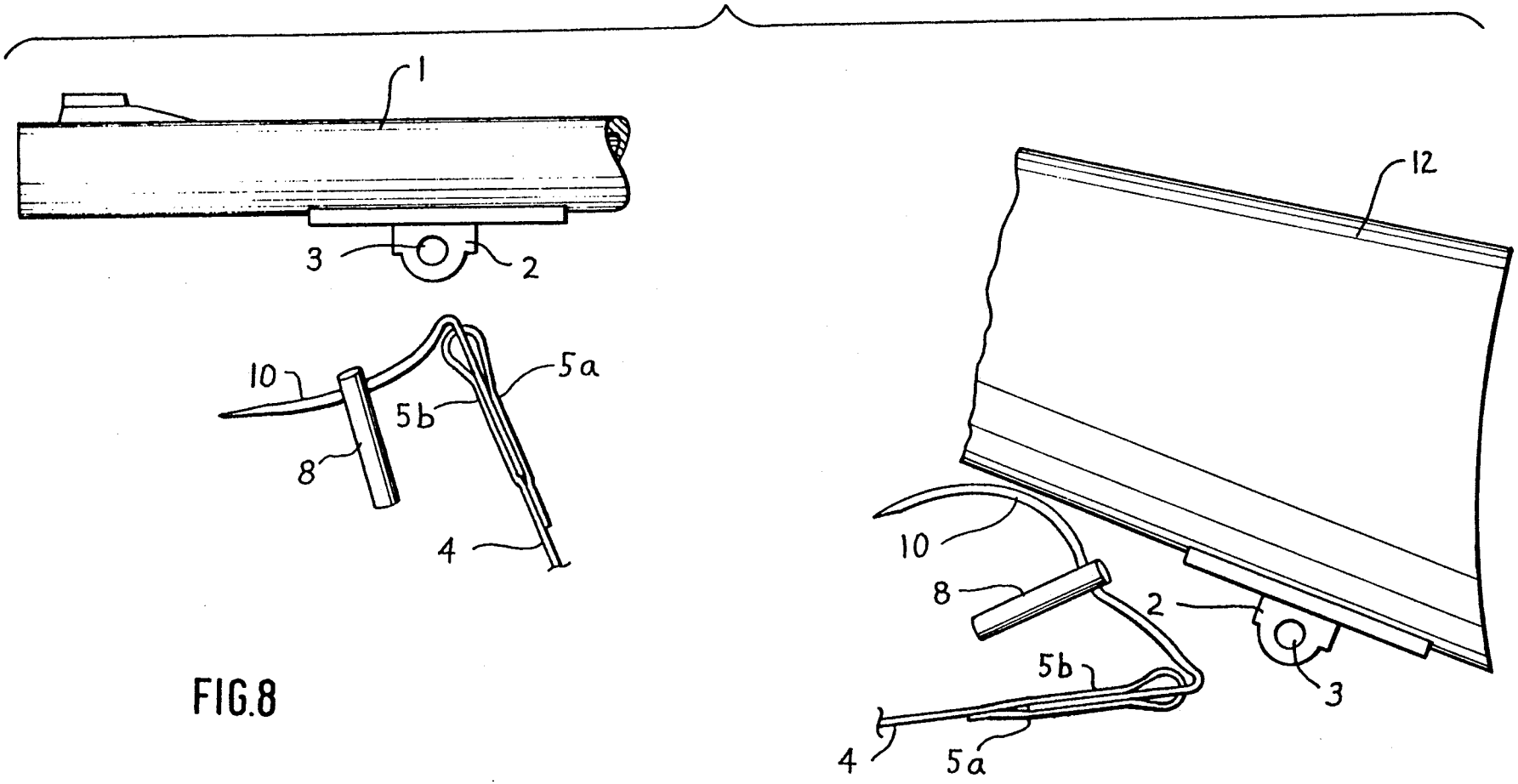
FIG. 8 is a view of the sling sleeves detached from the respective sling mounts of the rifle.

In order that the retaining thong 10, 10' may be threaded easily into the slot 9, the width of the retaining thong 10, 10' should reduce towards the free end, as is shown in FIGS. 4 and 7.

The retaining thong 10, 10' advantageously consists of leather. The connection of the retaining thong 10 or the retaining thongs 10, 10' to the rifle sling 4 is advantageously effected in that the retaining thong 10 or the retaining thongs 10, 10' are sewn in between the two sling sections 5a, 5b forming the sling sleeve 5.

The length L1 of the retaining pin 8 should be somewhat greater than the width B2 of the sling sleeve 5.

Fitting the rifle sling 4 to the rifle is effected in the embodiment shown in FIGS. 1 to 4 in that the retaining thong 10 is firstly drawn through one slot 9 of the retaining pin 8. Then the sling sleeve 5 is pushed with its recess over the eye part 2. The free end of the retaining pin 8 is then stuck from one side firstly through the one half of the sling sleeve 5, then through the transverse bore 3 of the eye part 2 and finally through the second half of the sling sleeve. Then the retaining thong 10 is drawn through the second slot 9 of the retaining pin 8. Fitting is thus complete. Because of the rough surface of the leather of the retaining thong 10 and because of the rough surface of the milled slot 9, as well as the greater width of the retaining thong 10 relative to the slot 9, the retaining thong is retained securely in the slot and cannot slip out inadvertently.

Release is effected in reverse manner, the retaining thong 10 remaining permanently drawn through the first slot 9 however, whereby the retaining pin is always attached to the rifle sling 4 by the retaining thong and cannot be lost.

Figure 5:
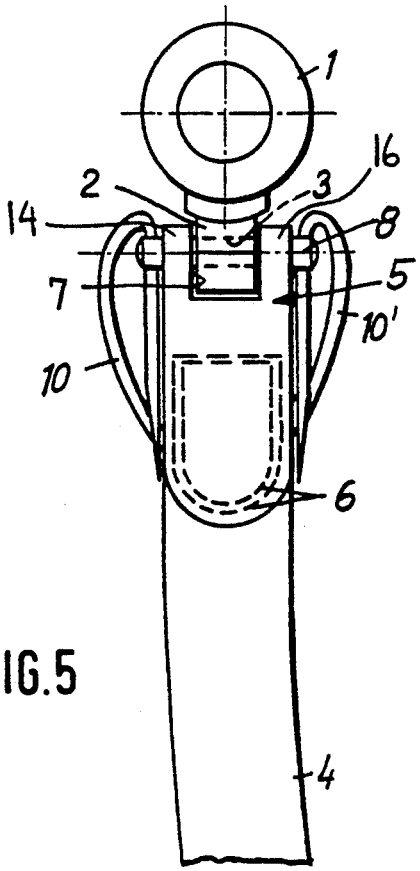
FIG. 5 is a second embodiment in a front view.
Figure 6:
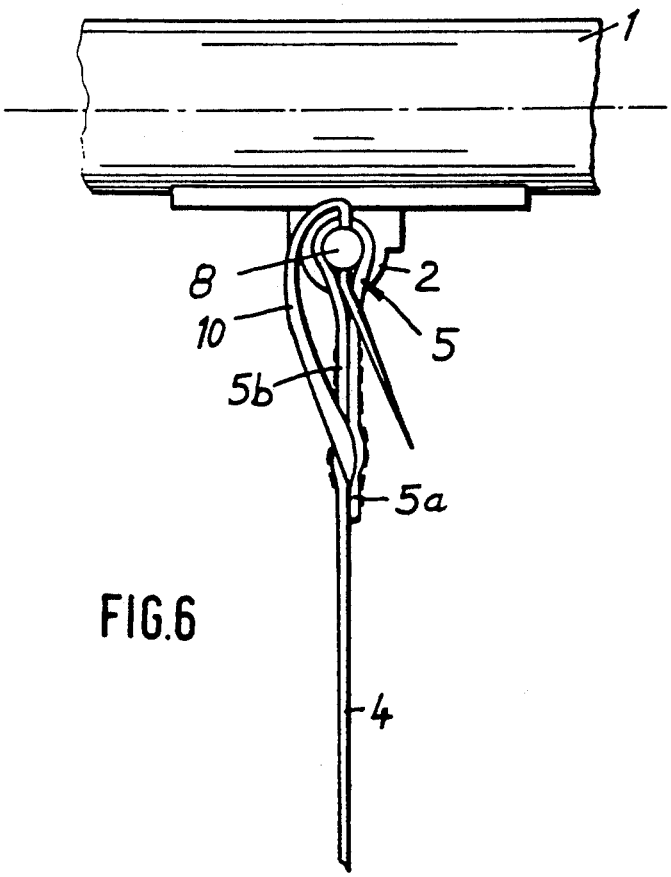
FIG. 6 is a corresponding side view.

The embodiment shown in FIGS. 5 to 7 differs from the previously described embodiment only in that, instead of one retaining thong, which is drawn through the two slots 9 of the retaining pin in turn, two retaining thongs 10, 10' are provided. Of these two retaining thongs one, for example the retaining thong 10, remains permanently through one of the slots 9, while the other retaining thong 10' can be pulled into or out of the second slot 9 for fitting and releasing respectively.

I claim:

1. An attachment device for attaching an elongate rifle sling to a rifle having first and second sling mounts provided thereon, the sling mounts each having a transverse bore therethrough, the rifle sling extending longitudinally in a first direction from the first sling mount to the second sling mount, the attachment device comprising:

first and second sling sleeves disposed at respective ends of the rifle sling, each said sling sleeve including an intermediate portion and a free end portion folded back over and secured to said intermediate portion, said intermediate and free end portions cooperating to define a pair of loops which are spaced-apart in a second direction traverse to the first direction with a notch extending therebetween, and a passage extending in said second direction through said loops, said notch extending in said first direction through said respective sling sleeve, the respective sling mount being disposed within said notch and the transverse bore thereof extending in said second direction coaxially with said passage;

first and second elongate retaining pins each having a longitudinal axis extending in said second direction within said respective passage and passing through said transverse bore disposed coaxially therein;

each said retaining pin including means defining a pair of through openings extending transversely of the longitudinal axis of said retaining pin, with each opening being oriented adjacent a respective end thereof; and at least one retaining strip means at each end of said rifle sling for facilitating a locking of said retaining pin in said passage by having a free end of said retaining strip means passing through at least one of said pair of openings in said retaining pin.

2. The device according to claim 1, wherein a width of the retaining strip means reduces in a direction toward the free end thereof.

3. The device according to claim 1, wherein the retaining strip means consists of leather.

4. The device according to claim 1, wherein the retaining strip means has a sufficient length to also pass through said second opening.

5. The device according to claim 1, wherein the length of the retaining pin in said second direction is greater than the width of the sling sleeve in said second direction.

6. The device according to claim 1, wherein each of said openings is an elongated slot, a longitudinal axis of said slot extending parallel to said longitudinal axis of said retaining pin.

7. The device according to claim 6, wherein a length of the slot in said second direction is smaller than a width of the retaining strip means in said second direction.

8. The device according to claim 1, wherein the retaining strip means is sewn on to the rifle sling.

9. The device according to claim 8, wherein the free end portion and the intermediate portion are sewn together and the retaining strip means is sewn between the free end portion and the intermediate portion.

10. The device according to claim 1, wherein said retaining strip means includes a further retaining strip means attached to the rifle sling adjacent said first-mentioned retaining strip means.

11. The device according to claim 10, wherein the first-mentioned retaining strip means passes through one of said pair of openings, and the second retaining strip means passes through the other of said pair of openings.

12. A device for attaching an elongate rifle sling to a rifle having first and second sling mounts provided thereon, the sling mounts each having a transverse bore therethrough, the rifle sling extending from the first sling mount to the second sling mount, said device comprising:

first and second sling sleeves disposed at respective ends of the rifle sling and each having at least one circumferentially continuous loop being coaxially aligned with the transverse bore of the respective sling mount;

first and second retaining pins extending through said respective axially aligned loops and transverse bores;

each said retaining pin including at least one opening therethrough;

retaining means for limiting relative movement between said retaining pin and said loop in a first direction extending parallel to a longitudinal axis of said retaining pin; and retaining strip means at one end of said rifle sling for preventing movement of said retaining pin in a direction opposite said first direction by having a free end of said retaining strip means pass through said opening.

13. The device as claimed in claim 12, wherein said retaining means includes a further opening in said retaining pin axially spaced from the first-mentioned opening on a side of the loop remote from the first-mentioned opening, and wherein said free end of said retaining strip means passes through the further opening.

14. The device as claimed in claim 12, wherein said retaining means includes a further opening in said retaining pin axially spaced from the first-mentioned opening on a side of the loop remote from the first-mentioned opening and a further retaining strip means attached to the rifle sling and having a free end of said further retaining strip means passing through said further opening.

15. The device as claimed in claim 14, wherein each said opening is an elongated slot having a length in said first direction smaller that a width of each said retaining strip means in said first direction.

16. The device as claimed in claim 14, wherein a width of each said retaining strip means is reduced in a direction toward said respective free end thereof.

17. The device as claimed in claim 14, wherein said retaining strips means are made from leather.

18. The device as claimed in claim 14, wherein a length of each said retaining pin in said first direction is greater than a width of said respective sling sleeves in said first direction.

19. The device as claimed in claim 14, wherein said first and second sling sleeves each include a free end portion of said rifle sling folded back and attached to an intermediate portion of said rifle sling with each said retaining strip means attached therebetween.

20. The device as claimed in claim 19, wherein said free end portion of said rifle sling and each said retaining strip means are sewn to said intermediate portion of said rifle sling.

* * * * *